US005096159A

United States Patent [19]

Fletcher

[11] Patent Number: 5,096,159

[45] Date of Patent: Mar. 17, 1992

[54] AUTOMOTIVE LIFT SYSTEM

[75] Inventor: Robert H. Fletcher, Glenwood, N.J.

[73] Assignee: Advantage Lift Systems, Inc., San Diego, Calif.

[21] Appl. No.: 643,021

[22] Filed: Jan. 18, 1991

[51] Int. Cl.[5] ..... B66F 7/12

[52] U.S. Cl. ..... 254/90; 254/10 R; 254/89 H; 187/8.72

[58] Field of Search ..... 254/8 R, 8 B, 8 C, 9 R, 254/9 B, 9 C, 10 R, 10 B, 10 C, 89 R, 89 H, 90, 124, 122; 187/8.41, 8.72

[56] References Cited

U.S. PATENT DOCUMENTS 4,763,761 8/1988 McKinsey et al. ..... 254/89 R 4,848,732 7/1989 Rossata ..... 254/90

FOREIGN PATENT DOCUMENTS 2084541 10/1980 United Kingdom ..... 254/90

*Primary Examiner*—Robert C. Watson

*Attorney, Agent, or Firm*—Melvin K. Silverman

[57] ABSTRACT

An automotive lift system includes a number of longitudinal transverse pairs of left and right legs each of which legs, include a top and a bottom. Each bottom is pivotally stationed to a base which in turn is positioned upon a floor. The lift system eliminates the need for torsion bars and provides ease of front-to-back and left-to-right access beneath an automotive vehicle that has been elevated.

5 Claims, 3 Drawing Sheets

AUTOMOTIVE LIFT SYSTEM

BACKGROUND OF THE INVENTION

Automotive lift systems have been long known in the prior art. However, during approximately the last fifteen years, the primary system used to perform maintenance and service upon and from underneath of automotive vehicles has changed from an in-ground post lift system to a so-called above-ground system.

The appeal of the above-ground lift system is largely in its environmental advantages. More particularly, the U.S. Environmental Protection Agency and the U.S. Occupational Safety and Hazards Agency have imposed strict and costly regulations relating to most forms of on-site excavation that include the use or storage of toxic chemicals in the ground. In the prior art of in-ground post-lift systems, it was necessary to store hydraulic, and other potentially hazardous materials underground. Accordingly, and primarily as a response to governmental regulation, the trend in the last fifteen years has been strongly away from in-ground post-lift systems and in the direction of above-ground lift systems.

Among the latter category, a type of lift known as a parallelogram lift has appeared. The term parallelogram is employed because, when viewed from the side, the structure thereof exhibits the configuration of a parallelogram. This style of lift is unique in the above-ground market in that it has eliminated the need for posts. Posts are undesirable in that they take-up room and create potential obstruction to workers. Further, the elimination of posts has brought about a saving of space, and are more efficient in function than prior art in-ground systems. However, the parallelogram lift has encountered market resistance in the United States due to reasons of its newness of design and regarding concerns in respect to its safety, notwithstanding the fact that the parallelogram-style lift is, by most standards of analysis, the safest lift manufactured in the United States today. Also, existing parallelogram systems make use of longitudinal on-ground elements, between the posts, which inhibit left-to-right access to the vehicle.

Prior art representative of such parallelogram automotive lift systems comprise the following:

U.S. Pat. No. 3,330,381 (1967) to Halstead, entitled Vehicle Lift; U.S. Pat. No. 4,447,042 (1984) to Maiser, entitled Vehicle Lift; and Canadian Patent No. 1,236,449 (1988) to Rossato, entitled Lifting Ramp.

It is a goal of the present invention to effect the elimination of torsion bars, that is, cross-connecting or cross-coupling elements between left and right rows of hydraulic lifting legs that are present in parallelogram lifts, and which impede front and rear access to the elevated vehicle.

It is another goal to provide a parallelogram system having improved left-to-right access, by eliminating longitudinal on-ground elements.

SUMMARY OF THE INVENTION

The present automotive lift system comprises a longitudinal plurality of transverse pairs of left and right rigid lifting legs, each leg having a top and a bottom, each bottom of each leg having a planer base anchored on a floor, each base pivotally secured to said leg bottom. The system further includes left and right longitudinal vehicle lifting platforms, said left and right platforms rotationally connected to each of the respective tops of said respective pairs of left and right rigid legs, said rotational connection including a piston-and-cylinder fluid power means for selectively changing the length of said means to modify the angle between each piston of said fluid power means and said respective legs of said system to thereby control the height of said wheel platforms above the floor and the angle of said wheel platforms relative to said rigid legs.

It is an object of the present invention to provide parallelogram automotive vehicle lift system having no transverse torsion bar or other transverse connecting means between the left and right sides of such system.

It is another object of the present invention to provide a parallelogram, above-ground, lift system which provides side-to-side and front-to-back access to the elevated vehicle without on-ground horizontal support elements between legs.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
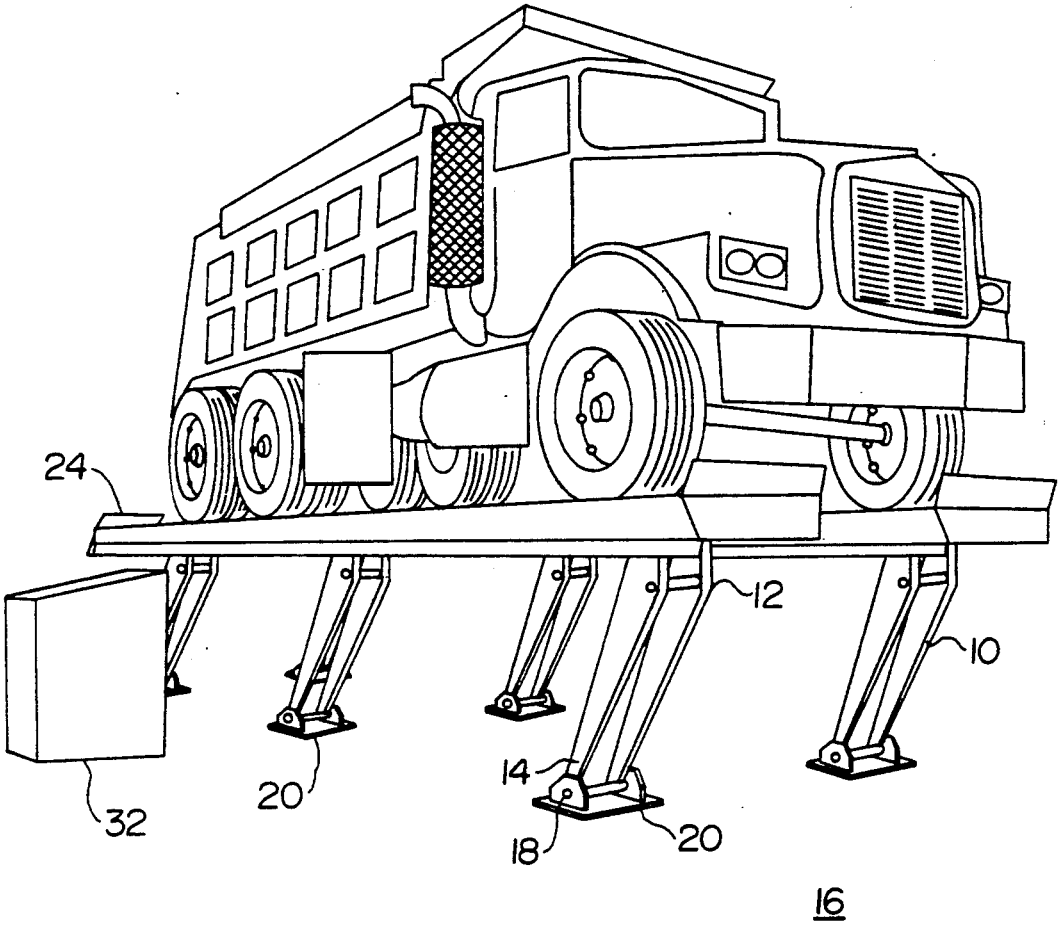
FIG. 1 is a perspective view of the inventive system showing a vehicle thereupon.
Figure 2:
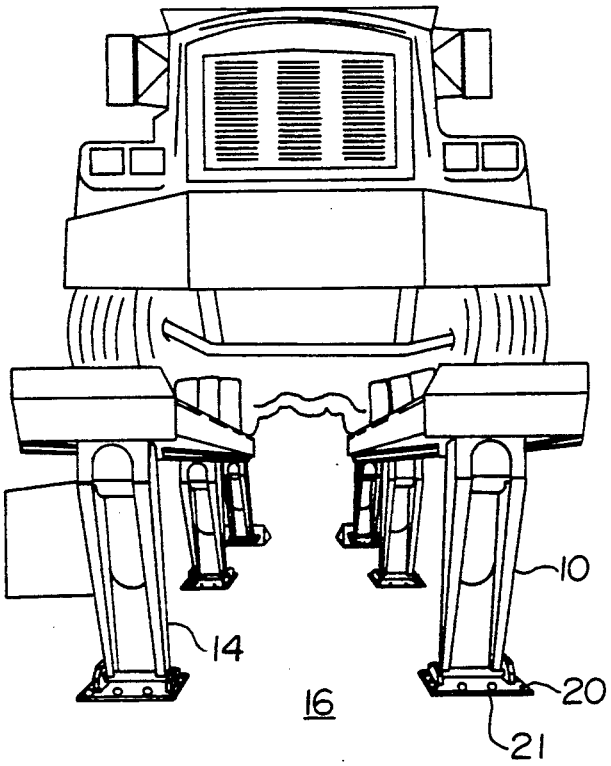
FIG. 2 is a front view of the illustration of FIG. 1.
Figure 3:
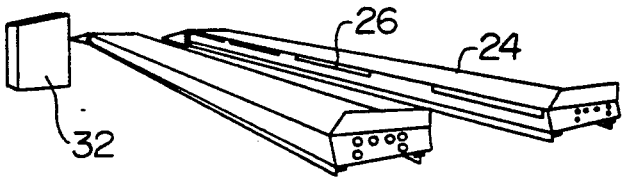
FIG. 3 is a perspective view of the vehicle wheel platforms employed in the inventive system.

With reference of the views of FIGS. 1 thru 3, the inventive automotive lift system is seen to include a longitudinal plurality of transverse pairs of left and right rigid lifting legs 10, each of said legs having a top 12 and a bottom 14. As may be noted, the bottom of each leg is anchored upon a floor 16 through a pivot point 18 within a planar base 20. Each of said bases 20 is secured, typically by screw means, to floor 16 which is typically made of a high impact concrete. The plane of said bases relative to floor 16 may be adjusted thru the use of leveling screws 21 and related lock nuts.

A distinctive feature of the instant invention resides in the fact that, unlike prior art devices, each base 20 is independent from every other base 20 in both the longitudinal and transverse direction. Accordingly access to vehicle 22 may be readily accomplished to the underside of the vehicle, either transversely (from left or right) or longitudinally (from the front or back).

With further reference to the views of FIGS. 1 thru 3, the inventive system is seen to include left and right longitudinal vehicles lift platforms 24. Said platforms 24 are rotationally moved at point 34 of top 12 of legs 10.

In the view of FIG., 3, it is noted that each wheel platform 24 is provided with lamps 26.

A hydraulic piston 28 is selectably extended or withdrawn relative to cylinder 30, employing control means 32 (See FIG. 1). The right end of cylinder 30 is rotationally connected to platform 24 at pivot point 29, while piston 28 is rotationally connected to leg 10 at pivot point 25. As may be appreciated, the function of hydraulic piston 28 and cylinder 30 is to selectively alter the angle between leg 10 and platform 24 to thereby change the height of the platform 24 relative to floor 16. The above is achieved by the dynamic co-action between pivot points 18, 25, 29 and 34.

In operation, a typical height of the wheel platforms above the floor will be sixty-three inches when piston 28 is extended to its maximum relative to cylinder 30.

Further, the dimensions of leg bases 20 should, it has been determined, be a square having an edge dimension approximately one-third of the maximum height of wheel platform 24 above floor 16, i.e., between about eighteen and twenty-one inches at each edge.

Figure 4:
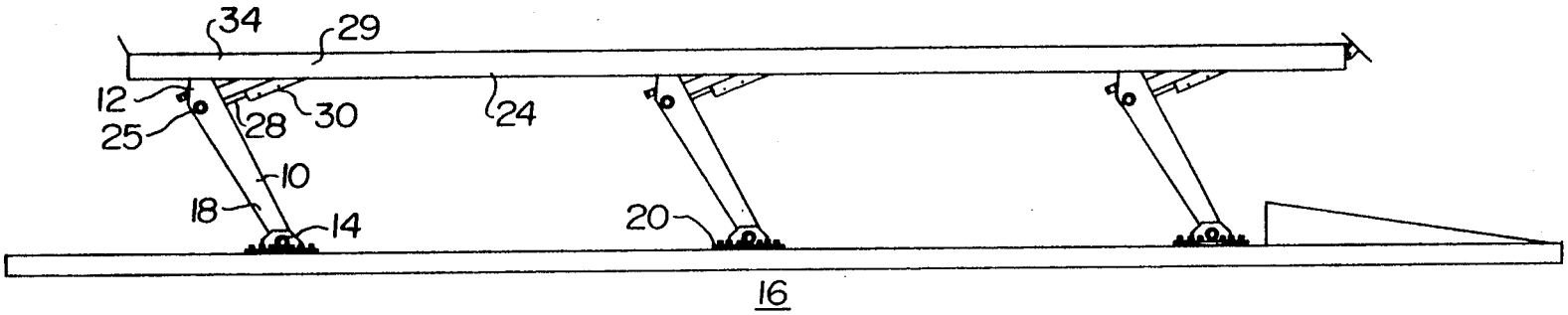
FIG. 4 is a side schematic view of the vehicle lift system, prior to elevation, without a vehicle thereupon.
Figure 5:
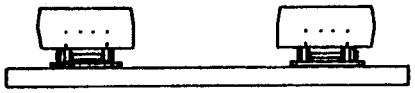
FIG. 5 is a front schematic view of FIG. 4.
Figure 6:
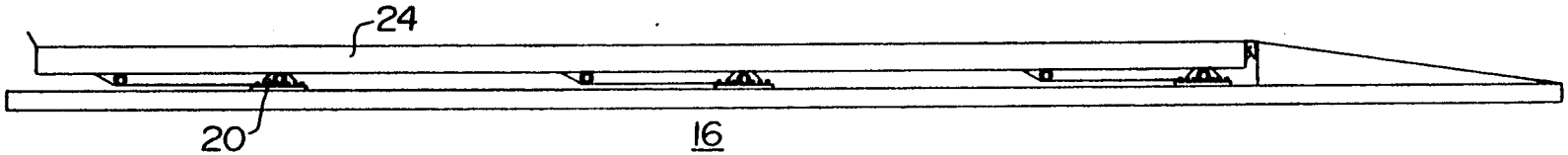
FIG. 6 is an operational view showing the vehicle lift system in operation.

The longitudinal dimensions of the wheel platforms 24 will vary depending upon the type of vehicle to be lifted. The typical range of such lengths is between twenty-five feet and forty-two feet. With reference to the view of FIG. 4, it is noted that the wheel platforms, when fully collapsed, occupy a height above the ground of between twelve and fourteen inches.

The hydraulic system reflected in piston 28, cylinder 30 and controller 32 can be operated with horsepower in the range of ten to fifteen, and upon 208/230/460/three phase A.C. power.

There is, resultingly, provided, a vehicle lift system which, in addition to equalizing wheel platform heights at the top of each leg, eliminates the need for torsion bars and provides ease of front-to-back and left-to-right access beneath an automotive vehicle that has been elevated.

Accordingly, while there has been shown and described the preferred embodiment of the present invention it is to be appreciated that the invention may be embodied otherwise than is herein specifically shown and described and that, within said embodiment, certain changes may be made within the form and arrangement of the part without departing from the underlying idea or principles of this invention as set forth in the claims appended herewith.

Having thus described my invention what I claim as new, useful and non-obvious and, accordingly, secured by Letters Patent of the United States is:

1. An on-ground automotive lift system, comprising:

(a) a longitudinal plurality of transverse pairs of left and right rigid lifting legs, neither any legs of said pairs of legs nor any longitudinally successive legs having any on-ground connection therebetween, each of said legs having a top and a bottom, each bottom of each leg having, pivotally secured therewith, a planer base which is anchored upon an on-ground floor; and (b) left and right longitudinal vehicle wheel support platforms, said left and right wheel platform having a pivotal connection relative to the respective tops of each of said respective pairs of left and right rigid legs, each pivotal connection including fluid piston and cylinder power means for selectively changing the effective length of the piston of said power means to correspondingly and synchronously modify the angulation between each piston, its corresponding lifting leg and its respective platform, to thereby synchronously control the angulation and height of each platform relative to said on-ground floor level.

2. The system as recited in claim 1, in which said bases of said legs comprise substantially a square having edge dimensions equal to about one-third of the maximum height of said lifting platform above said floor level.

3. The system is recited in claim 2, in which the length of said lifting platform in the range of 25 to 85 feet.

4. The system as recited in claim 3 in which said platform has a maximum height of about 60 inches above the floor level.

5. The system as recited in claim 1 in which said bases further comprise leveling screws for changing an angle of the plane of each base relative to the floor level.

* * * * *